US005250876A

United States Patent [19]

Van Mierlo et al.

[11] Patent Number: 5,250,876

[45] Date of Patent: Oct. 5, 1993

[54] DISPLAY TUBE AND DEFLECTION UNIT SUITABLE FOR SUCH A DISPLAY TUBE

[75] Inventors: Alexander G. J. G. Van Mierlo; Martinus A. M. Van den Heuvel, both of Eindhoven, Netherlands

[73] Assignee: U.S. Philips Corporation, New York, N.Y.

[21] Appl. No.: 888,470

[22] Filed: May 21, 1992

Related U.S. Application Data

[63] Continuation of Ser. No. 552,740, Jul. 12, 1990, abandoned.

[30] Foreign Application Priority Data

Jul. 14, 1989 [NL] Netherlands ..... 8901820
Feb. 16, 1990 [NL] Netherlands ..... 9000373

[51] Int. Cl.[5] ..... H01J 29/70

[52] U.S. Cl. ..... 313/440; 313/431; 335/211

[58] Field of Search ..... 313/440, 431; 335/211, 335/212

[56] References Cited

U.S. PATENT DOCUMENTS

| | | | |
|---|---|---|---|
| 3,810,053 | 5/1974 | McGlashan | 335/212 |
| 4,143,345 | 3/1979 | Barkow | 335/212 |
| 4,231,009 | 10/1980 | Barkow | 335/212 |
| 4,242,612 | 12/1980 | Heijnemans et al. | 313/421 |
| 4,246,560 | 1/1981 | Shimizu et al. | 335/212 |
| 4,535,313 | 8/1985 | Van der Heijde | 335/212 |

*Primary Examiner*—Sandra L. O'Shea
*Attorney, Agent, or Firm*—Robert J. Kraus

[57] ABSTRACT

A display tube comprising a deflection unit having a field deflection coil 12 and a line deflection coil 11. Field-guiding elements 17 and 18 are arranged between the field deflection coil 12 and the line deflection coil 11 in such a manner that they produce little or no vibration.

9 Claims, 2 Drawing Sheets

DISPLAY TUBE AND DEFLECTION UNIT SUITABLE FOR SUCH A DISPLAY TUBE

This is a continuation of application Ser. No. 07/552,740, filed Jul. 12, 1990, now abandoned.

BACKGROUND OF THE INVENTION

The invention relates to a display tube comprising a deflection unit having a carrier, a field deflection coil, a line deflection coil and field-guiding means.

The invention further relates to a deflection unit which is suitable for such a display tube.

Such a display tube can be used in black and white, colour and projection television, in data-display equipment and in other apparatuses in which a cathode ray tube is used.

When the deflection unit is energized it deflects an electron beam generated in the display tube to form an image to be displayed.

In some cases, however, it appears that during the display of an image the display tube brings about an undesirable sound which is irritating to the viewer.

SUMMARY OF THE INVENTION

It is an object of the invention to provide, inter alia, a display tube in which the generation of undesirable sound during the operation of the tube is at least substantially prevented.

For this purpose, a display tube of the type described in the opening paragraph is characterized according to the invention in that the field-guiding means are provided in the deflection unit in a manner such that they produce little or no vibration.

The invention is based on the insight that the occurrence of undesirable sound can be largely attributed to the fact that the fields generated when the deflection unit is energized cause the field-guiding means to vibrate in an undesirable manner. Said undesirable generation of sound is largely precluded by providing the field-guiding means in a little vibration producing manner according to the invention.

A preferred embodiment of a display tube according to the invention is characterized in that the field-guiding means are secured on the carrier and encapsulated in electrically insulating material. In particular when the field-guiding means are secured on the carrier, it appears that the degree to which undesirable vibrations occur is very high. The reason for this being that the forces which are exerted on the field-guiding means when the deflection unit is energized can be so large that the carrier is made to vibrate via the field-guiding means. The carrier acts as a resonance box causing the undesirable sound to be intensified. The vibrations are damped to a sufficient degree by encapsulating the field-guiding means in electrically insulating material.

Preferably, the encapsulation of the field-guiding means takes place by filling the space around said field-guiding means with the electrically insulating material. Preferably, said electrically insulating material is a curing synthetic resin. Polyurethane foam is particularly suitable because it can be provided in a simple manner.

A further preferred embodiment of a display tube according to the invention is characterized in that the field-guiding means are secured to one of the deflection coils. Undesirable vibrations are precluded in that the field-guiding means are not secured to the carrier but to one of the deflection coils, for example the field deflection coil. As a result thereof, the carrier no longer acts as a resonance box. The fixation is preferably carried out using a rapidly curing adhesive, thus obtaining a fast and accurate fixation.

A display tube according to a further preferred embodiment of the invention, which is characterized in that the field-guiding means comprise two soft magnetic elements which are arranged to produce little vibration, diametrally opposite each other between the field deflection coil and the line deflection coil, substantially parallel to the magnetic field of the field deflection coil, near the centre of the field deflection coil, exhibits an extremely low noise behaviour during the display of an image.

The invention further relates to a deflection unit for a display tube, said deflection unit comprising a carrier, a field deflection coil, a line deflection coil and field-guiding means, and is characterized in that the field-guiding means are arranged in the deflection unit so as to produce little vibration.

BRIEF DESCRIPTION OF THE DRAWING

These and other aspects of the invention will be described and explained by means of the accompanying drawing and the examples, in which.

DESCRIPTION OF THE PREFERRED EMBODIMENTS

Figure 1:
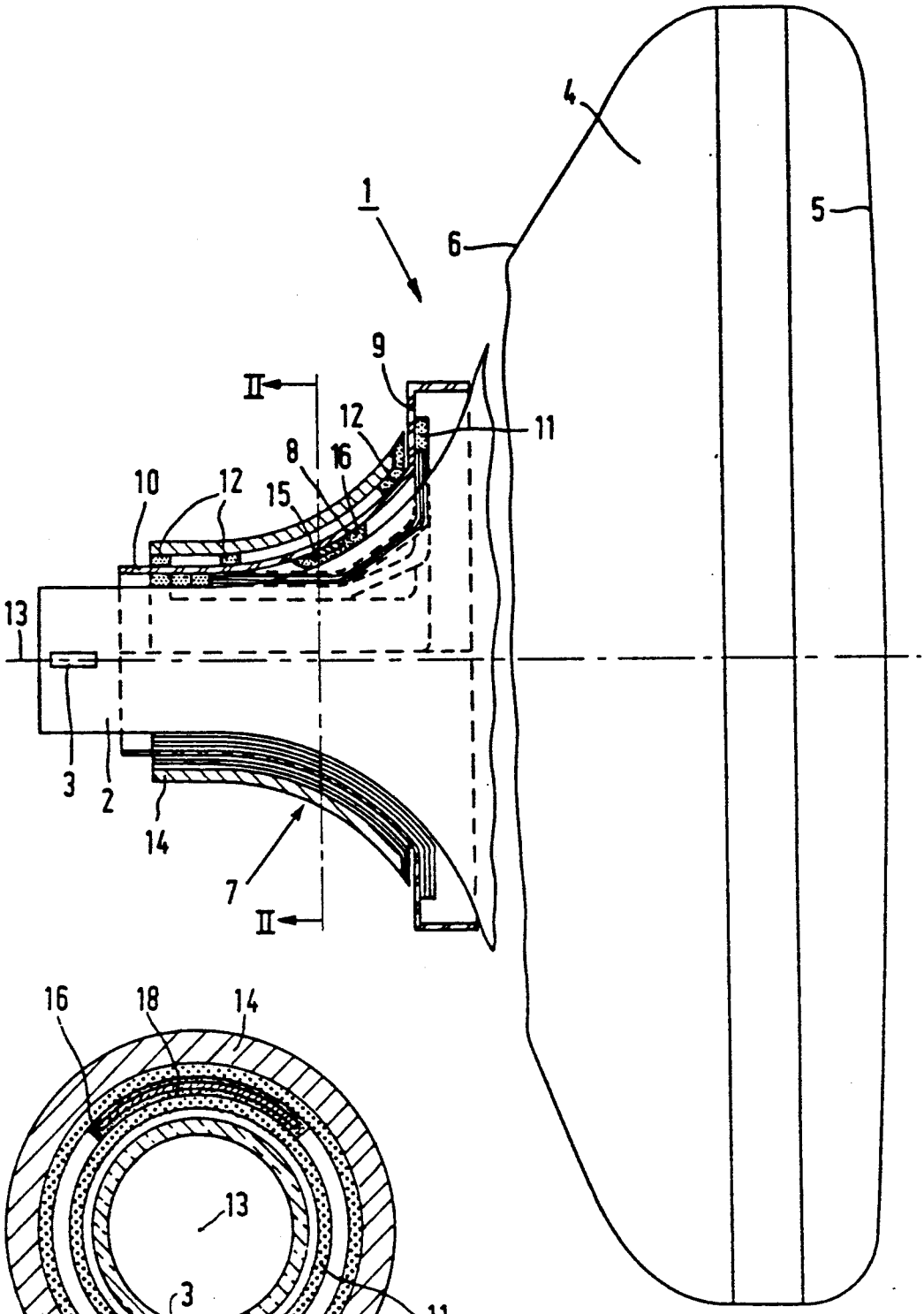
FIG. 1 is a diagrammatic longitudinal sectional view of a display tube according to the invention having a deflection unit.

FIG. 1 is a longitudinal sectional view of a display tube 1 comprising a neck portion 2 in which an electron-gun system 3 is mounted, a conical enveloping portion 4 and a display window 5. A deflection unit 7 is mounted on the display tube 1 at the transition from the neck portion 2 to the enveloping portion 4. Said deflection unit 7 comprises a carrier 8 of electrically insulating material having a front end portion 9 and a rear end portion 10. Between these end portions there are a line deflection coil 11, on the inside of the carrier 8, for generating a (line) deflection field for deflecting electron beams produced by the electron-gun system 3 in the horizontal direction, and a field deflection coil 12, on the outside of the carrier 8, for generating a (field) deflection field in the vertical direction. Said deflection coils 11 and 12 are surrounded by an annular core 14 of ferromagnetic material.

In this embodiment, field-guiding means 15 are arranged between the field deflection coil 12 and the line deflection coil 11 by securing them to the carrier 8. The field-guiding means 15 are arranged so as to produce little vibration by encapsulating them in electrically insulating material 16. The material has to be electrically insulating to preclude a short-circuit between the field deflection coil and the line deflection coil. Vibrations, if any, are damped by said electrically insulating material 16.

The invention applies, in particular, to field-guiding means 15 which serve to influence the deflection fields in such a manner that a satisfactory astigmatic level with a tolerably small coma can be realized (so-called astigmatism laminations).

Figure 2:
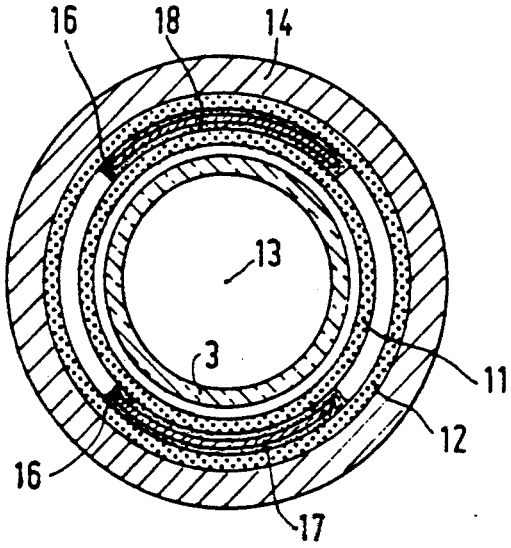
FIG. 2 is a diagrammatic cross-sectional view of a display tube according to an alternative embodiment of the invention.

Preferably, the space between the field deflection coil 12 and the line deflection coil 11 is filled with a curing synthetic resin 16 at the location of the field-guiding means 15, so that said field-guiding means 15 are efficiently arranged in a vibrationless manner (see FIG. 2). As diagrammatically shown in FIG. 2, the field-guiding means are preferably formed by two soft magnetic elements 17 and 18 which are arranged diametrally opposite each other, substantially parallel to the magnetic field of the field deflection coil 12. Before the synthetic resin has cured, it can be provided in the space between the field deflection coil and the line deflection coil in a simple manner. Polyurethane foam is particularly suitable. In addition, epoxy resins and suitable adhesives can alternatively be used as electrically insulating materials. Thus, the electrically insulating material 16 which surrounds the field-guiding means may have two functions. Firstly, it permits the field-guiding means to be secured in the deflection unit and, secondly, it damps any vibrations. As a result hereof, the occurrence of undesirable sounds in the display tube when an image is displayed is largely precluded.

Figure 3:
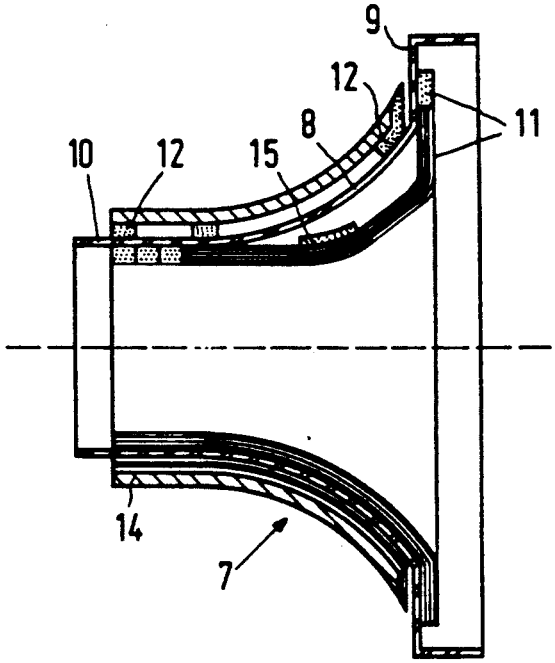
FIG. 3 is a diagrammatic longitudinal sectional view of a deflection unit according to the invention, in which the field-guiding means are provided on one of the deflection coils.

FIG. 3 is a diagrammatic longitudinal sectional view of a deflection unit 7 in which the field-guiding means 15 are secured directly on one of the deflection coils, in this case the line deflection coil 11. Preferably, a rapidly curing adhesive, for example a UV-curing adhesive is used to secure the field-guiding means to the line deflection coil 11. To enable the electromagnetic field to be influenced in a defined manner, it must be possible to rapidly fix an accurately adjusted position of the field-guiding means 15 relative to the deflection coils. This is achieved by the use of a rapidly curing adhesive.

The use of less rapidly curing adhesives is alternatively possible, but this implies that the field-guiding means have to be held in the desired position relative to the deflection coils for a longer period of time until the adhesive has cured and the position has been fixed.

An additional advantage of securing the field-guiding means on the deflection coils is that in the case of vibrations the positioning of the field-guiding means and the deflection coils relative to each other does not change. Consequently, the electromagnetic fields generated remain unchanged when vibrations occur. Thus, an image to be displayed by the display tube is hardly adversely influenced as a result of undesirable shifts of field-guiding means and deflection coils.

We claim:

1. A display tube comprising an envelope including a display window, an electron gun system disposed within the envelope, and a deflection unit mounted on the envelope, said deflection unit comprising first and second deflection coil devices for producing respective deflection fields, a carrier device of electrically insulating material having a substantial portion thereof disposed between the first and second deflection coil devices, and magnetic field guiding means secured to the carrier device disposed between the first and second deflection coil devices, said field guiding means and adjacent areas of the carrier device being covered by an electrically insulating, vibration dampening material to substantially avoid effecting resonant vibration of the carrier device during operation of the display tube.

2. A display tube as in claim 1 where open space proximate the field guiding means is filled with the vibration dampening material.

3. A display tube as in claim 1 or 2 where the vibration dampening material consists essentially of a curing synthetic resin.

4. A display tube as in claim 3 where the vibration dampening material consists essentially of a polyurethane foam.

5. A display tube as in claim 1, 2 or 4 where the field guiding means comprises first and second soft magnetic elements disposed diametrically opposite each other, proximate the center of one of said deflection coil devices and oriented substantially parallel to the deflection field produced by the one of said deflection coil devices.

6. A display tube comprising an envelope including a display window, an electron gun system disposed within the envelope, and a deflection unit mounted on the envelope, said deflection unit comprising:

a. a coil support;

b. a field deflection coil arrangement disposed on a first side of the coil support;

c. a line deflection coil arrangement disposed on an opposite side of said coil support; and d. magnetic field guiding means attached to said coil support and comprising first and second soft magnetic elements which are arranged diametrically opposite each other between the field deflection coil and the line deflection coil near the center of the field deflection coil and oriented substantially parallel to a deflection field produced by one of said coils, said field guiding means and adjacent areas of the coil support being covered by an electrically insulating, vibration dampening material.

7. A display tube as in claim 6 where the vibration dampening material consists essentially of a curing synthetic resin.

8. A display tube as in claim 7 where the vibration dampening material consists essentially of a polyurethane foam.

9. A display tube as in claim 6 where the field deflection coil is disposed on an outer side of the coil support and where the magnetic field guiding means are oriented substantially parallel to the deflection field produced by the field deflection coil.

* * * * *